US012030594B2

(12) United States Patent
Li et al.

(10) Patent No.: US 12,030,594 B2
(45) Date of Patent: Jul. 9, 2024

(54) TRUSS SYSTEM AND METHODS OF USE THEREOF FOR OFFSHORE PLATFORMS

(71) Applicant: Exmar Offshore Company, Houston, TX (US)

(72) Inventors: Zhongwei Li, Houston, TX (US); Aimin Wang, Houston, TX (US); Jonathan Wang, Houston, TX (US); Otto DaSilva, Houston, TX (US)

(73) Assignee: Exmar Offshore Company, Houston, TX (US)

( * ) Notice: Subject to any disclaimer, the term of this patent is extended or adjusted under 35 U.S.C. 154(b) by 198 days.

(21) Appl. No.: 17/650,494

(22) Filed: Feb. 9, 2022

(65) Prior Publication Data

US 2022/0266950 A1 Aug. 25, 2022

Related U.S. Application Data

(60) Provisional application No. 63/147,636, filed on Feb. 9, 2021.

(51) Int. Cl.
*B63B 3/32* (2006.01)
*B63B 3/14* (2006.01)

(52) U.S. Cl.
CPC ..... *B63B 3/32* (2013.01); *B63B 2003/145* (2013.01)

(58) Field of Classification Search
CPC ..... B63B 1/107; B63B 2001/128; B63B 3/32; B63B 2003/145
USPC ..... 114/39.21, 65 R, 85, 258, 264, 266, 267
See application file for complete search history.

(56) References Cited

U.S. PATENT DOCUMENTS

| | | | | |
|---|---|---|---|---|
| 6,997,132 | B2 * | 2/2006 | Steen | B63B 35/4413 114/259 |
| 9,145,190 | B2 | 9/2015 | Knecht et al. | |
| 2005/0058513 | A1 * | 3/2005 | Martensson | B63B 35/4413 405/203 |
| 2012/0090524 | A1 | 4/2012 | Khachaturian | |

FOREIGN PATENT DOCUMENTS

| | | | |
|---|---|---|---|
| EP | 2815957 | A1 | 12/2014 |
| KR | 101627667 | B1 | 6/2016 |
| WO | 96-23690 | A1 | 8/1996 |

OTHER PUBLICATIONS

International Search Report issued in International Application No. PCT/US2022/015852 dated Jun. 10, 2022 (4 pages).
Written Opinion issued in International Application No. PCT/US2022/015852 dated Jun. 10, 2022 (5 pages).
International Preliminary Report on Patentability issued in International Application No. PCT/US2022/015852 mailed on Aug. 15, 2023 (6 pages).

* cited by examiner

*Primary Examiner* — Daniel V Venne
(74) *Attorney, Agent, or Firm* — Osha Bergman Watanabe & Burton LLP

(57) ABSTRACT

A truss system may include a plurality of beams. Each beam of the plurality of beams may have various cross-sectional sizes in a same plane. Additionally, the plurality of beams may have a geometric arrangement such that a structural weight at required strength level may be reduced to achieve optimal design.

18 Claims, 7 Drawing Sheets

TRUSS SYSTEM AND METHODS OF USE THEREOF FOR OFFSHORE PLATFORMS

BACKGROUND OF THE DISCLOSURE

Field of the Disclosure

Embodiments disclosed herein generally relate to a truss system for offshore platforms. More specifically, embodiments disclosed herein relate to geometry arrangements of the truss system to optimally distribute structural material to have a balance between structural weight and structural strength.

Description of Related Art

In oilfield operations, offshore vessels, such as platform supply vessels (PSV), offshore barges, anchor handling vessels, construction support vessels (CSV), drilling vessels, well intervention vessels, ice breaking vessels, crane vessels, cable laying vessels, seismic vessels, and firefighting vessels, are commonly used for various tasks, including, but not limited to, hydrocarbon exploration, hydrocarbon drilling and production, holding and transporting hydrocarbons, safety platforms, and heavy lift cranes.

The offshore vessels may typically have a topside structure to carry equipment payloads and environment loads. Further, stability columns such as pencil columns or rocket columns may be attached to the offshore vessels to stabilize the offshore vessels in a body of water. The topside structure may be a truss system to form the decks. A structural weight of the truss system needs to be reduced in order to maximize the pay load, while a structural strength criterion of the truss system must be satisfied for the harsh environment. In offshore environments, it is crucial to distribute the structural material efficiently in order to satisfy both the weight and strength requirements.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a truss system. The truss system may include a plurality of beams. Each beam of the plurality of beams may have various cross-sectional sizes in a same plane. Additionally, the plurality of beams may have a geometric arrangement such that a structural weight at required strength level may be reduced to achieve optimal design.

In another aspect, the embodiments disclosed herein relate to a lower deck for a topside truss system of an offshore vessel. The lower deck may include a plurality of beams distributed into four quadrants. The plurality of beams may extend in a direction parallel to an X-axis in a plane of the lower deck, parallel to a Y-axis in the plane, and angled at an acute or obtuse angle off the X-axis and the Y-axis. Each quadrant includes a first set of beams having a constant or varying cross-section, a second set of beams having a constant or varying cross-section, a third set of beams having a constant or varying cross-section, and a fourth set of beams having a constant or varying cross-section.

In yet another aspect, the embodiments disclosed herein relate to an offshore vessel. The offshore vessel incudes a base having one or more support columns support members disposed thereon and a deck formed by a topside truss system supported by the one or more support columns support. The topside truss system includes an upper deck, a lower deck, and tubular members interconnecting the upper deck to the lower deck. The lower deck may have one or more quadrants with a first set of beams having a constant or varying cross-section, a second set of beams having a constant or varying cross-section, a third set of beams having a constant or varying cross-section, and a fourth set of beams having a constant or varying cross-section. Additionally, corresponding corner beam members of the topside truss system are affixed to a top of the one or more support columns.

Other aspects and advantages of the disclosure will be apparent from the following description and the appended claims.

DETAILED DESCRIPTION

Figure 1:
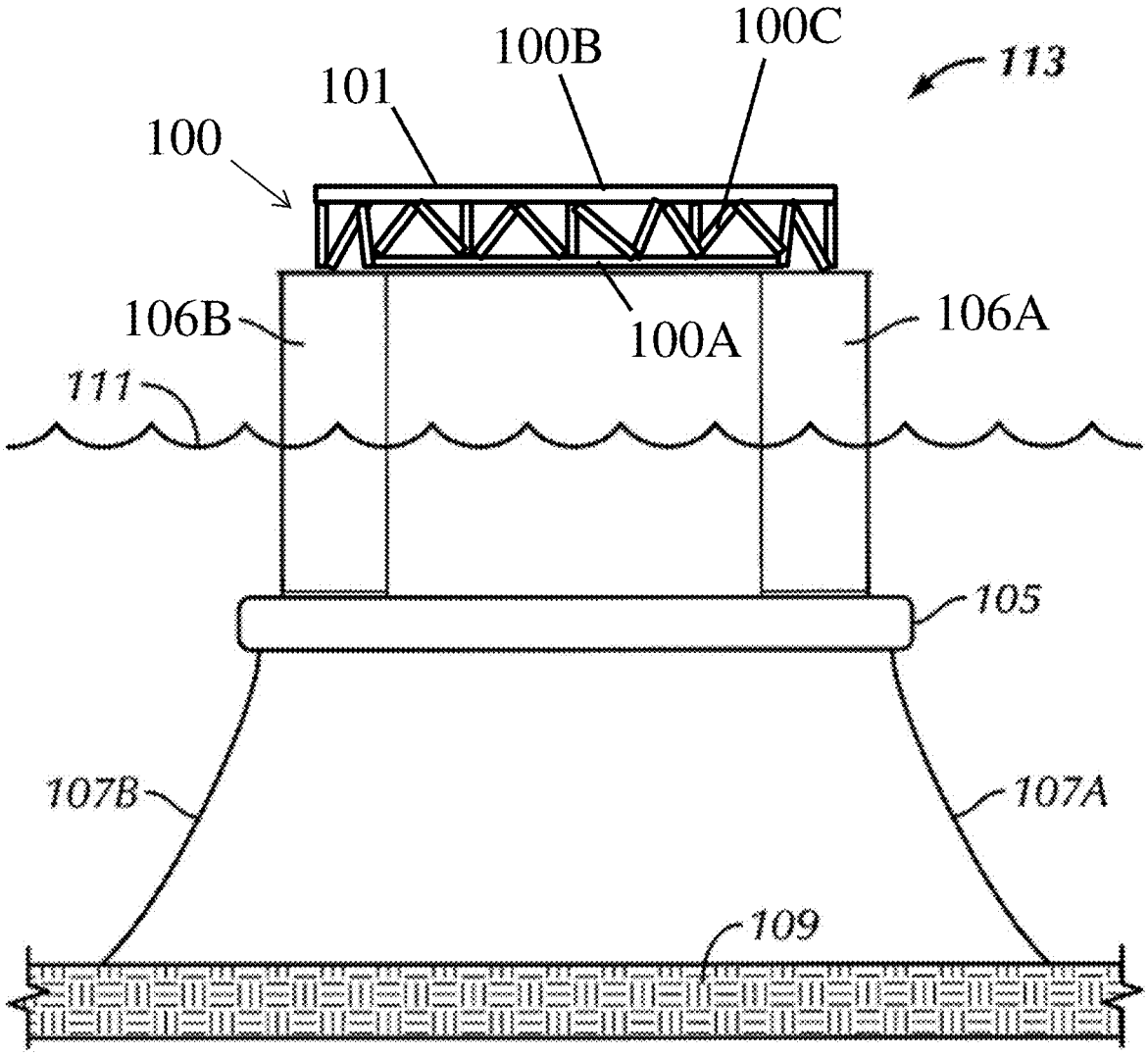
FIG. 1 illustrates a side view of an offshore vessel in a typical offshore environment in accordance with one or more embodiments of the present disclosure.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing a first element to a second element disposed thereon, it is understood that disposing may be either directly disposing the first element on the second element, or indirectly disposing the first element on the second element. For example, a first element may be directly disposed on a second element, such as by having the first element and the second element in direct contact with each other, or a first element may be indirectly disposed on a second element, such as by having a third element, and/or additional elements, disposed between the first and second elements. As used herein, the term "attached to" or "coupled" or "coupled to" or "connected" or "connected to" may indicate establishing either a direct or indirect connection, and is not limited to either unless expressly referenced as such. Further, embodiments disclosed herein are described with terms designating an offshore vessel in reference to a floating vessel, but any terms designating offshore structure (i.e., any platform or semi-submersible) should not be deemed to limit the scope of the disclosure. Wherever possible, like or identical reference numerals are used in the figures to identify common or the same elements. The figures are not necessarily to scale and certain features and certain views of the figures may be shown exaggerated in scale for purposes of clarification.

In one aspect, embodiments disclosed herein generally relate to a truss system for a topside structure of an offshore vessel. The truss system may be formed by a plurality of beams interconnected together. More specifically, a geometry of the beams may be in an arrangement such that a structural weight of the truss system and a structural strength of the truss system are optimized. In one or more embodiments, the truss system may be disposed on columns of the offshore vessel. In other embodiments, the truss system may be designed for use with onshore structures, such as oil derricks. Further, the truss system may be designed for use in any marine or land environment without departing from the scope of the present disclosure. It is to be further understood that the various embodiments described herein may be used in various stages of offshore oil and gas operations, such as rig site preparation, drilling, completion, abandonment etc., and in other environments, such as workover rigs, fracking installation, well-testing installation, oil and gas production installation, without departing from the scope of the present disclosure. The embodiments are described merely as examples of useful applications, which are not limited to any specific details of the embodiments herein.

Turing to FIG. 1, a side view of an offshore vessel 113 in a typical marine environment is shown. For example, the offshore vessel 113 may be a semi-submersible structure for oil and gas operations. A deck 101 sits above the surface of water 111. The deck 101 is typically used for drilling, production, or other operations and therefore operating equipment, personnel, and operation gear may be disposed thereon. Because of ocean wave loads, platform motion and topsides payload, the typical design load conditions for the offshore vessel 113 may be vertical bending moment, lateral shear, pry-squeeze, pitch connecting moment, and lateral acceleration. The deck 101 is formed by a topside truss system 100. The topside truss system 100 includes two or more deck levels (100A, 100B). For example, an upper deck 100B is interconnected to a lower deck 100A by tubular members 100C.

In one or more embodiments, the topside truss system 100 may be supported by one or more support columns. As shown in this example, topside truss system 100 is disposed on support columns 106A and 106B and is therefore kept away from any large waves at the surface of the water 111. Support columns 106A and 106B are used to support topside truss system 100, but may also serve as storage. In addition, support columns 106A and 106B may be ballasted. A base, such as pontoon base 105, has the support columns 106A and 106B disposed thereon. The pontoon base 105 may be substantially rectangular in shape from a side view perspective, a plan view perspective, or both. In some embodiments, the topside truss system 100, the one or more support columns, and the pontoon base 105 may be one integrated system forming the offshore vessel 113.

The offshore vessel 113 obtains buoyancy from ballasted pontoons or ballasted columns. As such, the ballasted structure(s) (ballasted pontoons or ballasted columns or both) may be filled with water or any other ballasting material (ballasting) or may release water or any other ballasting material (deballasting) to stabilize the offshore vessel 113. As shown, the semi-submersible 113 is anchored to the seabed 109 by anchor lines 107A and 107B. The anchor lines 107A and 107B may be wires, chains, or any other anchoring device known in the art that would keep the semi-submersible in a proper position with respect to the seabed 109. Furthermore, anchor lines may not be limited to only two lines as shown in this example. The offshore vessel 113 may be anchored by any number of anchor lines.

In some embodiments, for use in marine environments with a shallower water depth, the offshore vessel 113 may be adapted to be disposed on seabed 109 without the use of anchor lines 107A and 107B. In this case, the pontoon base 105 may be disposed on the seabed 109 and may be affixed to the seabed 109 using an affixing unit (not shown) to affix the pontoon base 105 and ultimately, the offshore vessel 113, to the seabed 109.

Figure 2A:
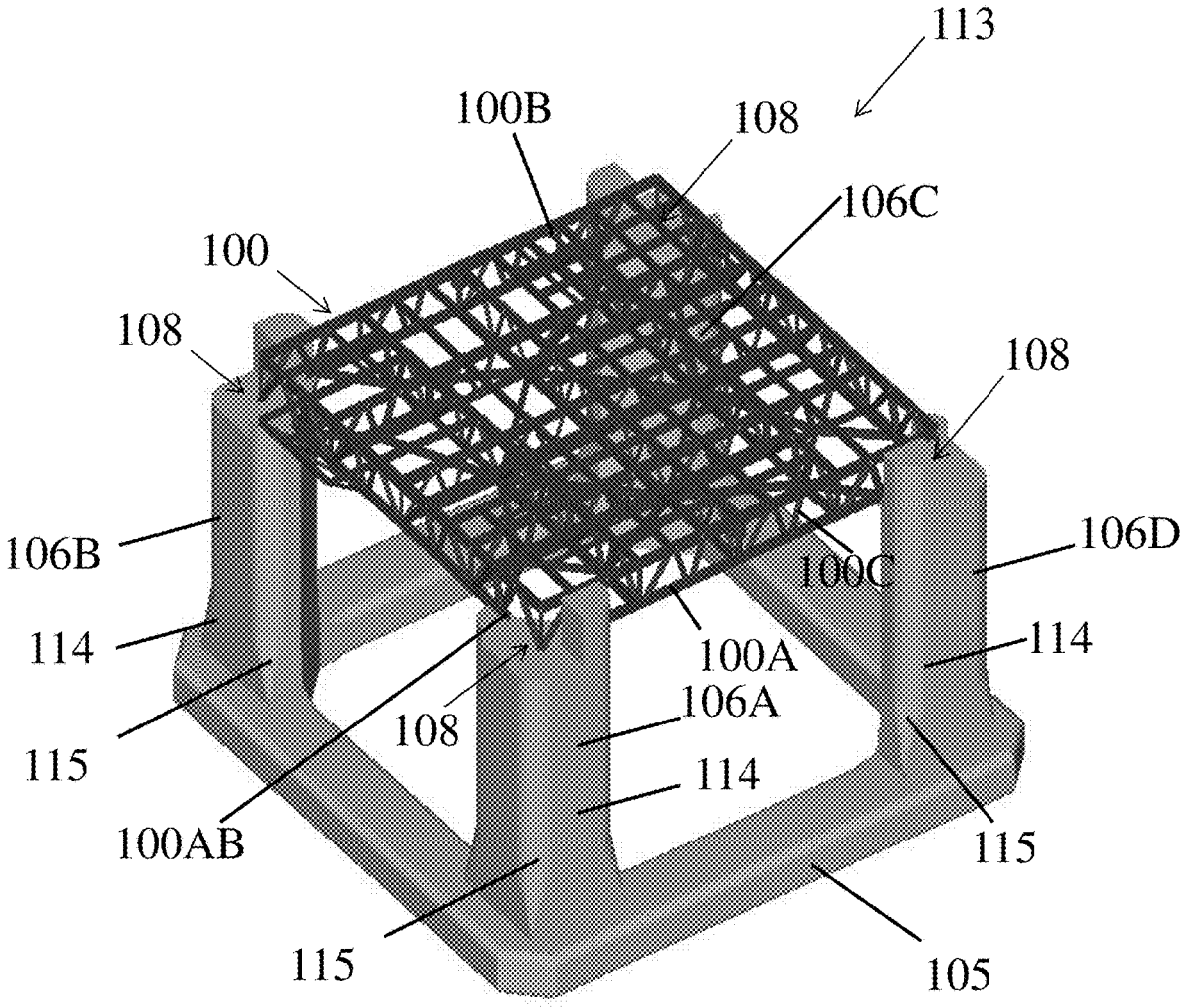
FIG. 2A illustrates a perspective view of the offshore vessel of FIG. 1 in accordance with one or more embodiments of the present disclosure.

With reference to FIG. 2A, a perspective view of the offshore vessel 113 is shown. The offshore vessel 113 may include four support columns 106A-106D extending upward from the pontoon base 105. The topside truss system 100 is disposed on the four support columns 106A-106D via corresponding corner beam members 108 of the topside truss system 100 for each of the four support columns 106A-106D. For example, tubular members of the corresponding corner beam members 108 may be affixed to a top of the four support columns 106A-106D. The corresponding corner beam members 108 may be made of tubular members similar to the tubular members 100C interconnecting the upper deck 100B to the lower deck 100A. In some embodiments, corresponding corner beam ends 100AB of the lower deck 100A are also affixed to the top of the four support columns 106A-106D a distance from the corresponding corner beam members 108.

In one or more embodiments, the support columns 106A-106D and the pontoon base 105 form a hull of the offshore vessel 113. As shown in FIG. 1, the support columns 106A-106D are disposed on the pontoon base 105. Also, in this case, the pontoon base 105 may be generally rectangular, triangular, and/or polygonal in shape and the support columns 106A-106D may be disposed near the corners of or at any position along the pontoon base 105. One of ordinary skill in the art would know and appreciate that the position of the support columns 106A-106D are not limited to the corners of the pontoon base 105, as the support columns 106A-106D may be arranged in any other configuration with respect to the pontoon base 105. In addition, one of ordinary skill in the art would know and appreciate that the number of support columns is not limited to four support columns 106A-106D, as shown, as there may be any number of support columns. A non-limiting example of the offshore vessel 113 may be described in U.S. Pat. No. 9,145,190, the entire teachings of which are incorporated herein by reference. It is further envisioned that offshore vessel 113 disclosed herein may be any semi-submersible in the art.

Still referring to FIG. 2A, in one or more embodiments, each of the support columns 106A-106D includes lines 114 to illustrate a vertical position along the support columns 106A-106D in which the sides of the columns 106A-106D join across a rounded edge and may gradually transition to joining across a squared edge. Additionally, regions 115 represent transition regions of the support columns 106A-

106D in which a rounded corner may gradually transition to a squared corner. In this example, the transition regions extend along a portion of the support columns 106A-106D and terminate at the connection between the columns 106A-106D and the pontoon base 105.

Figure 2B:
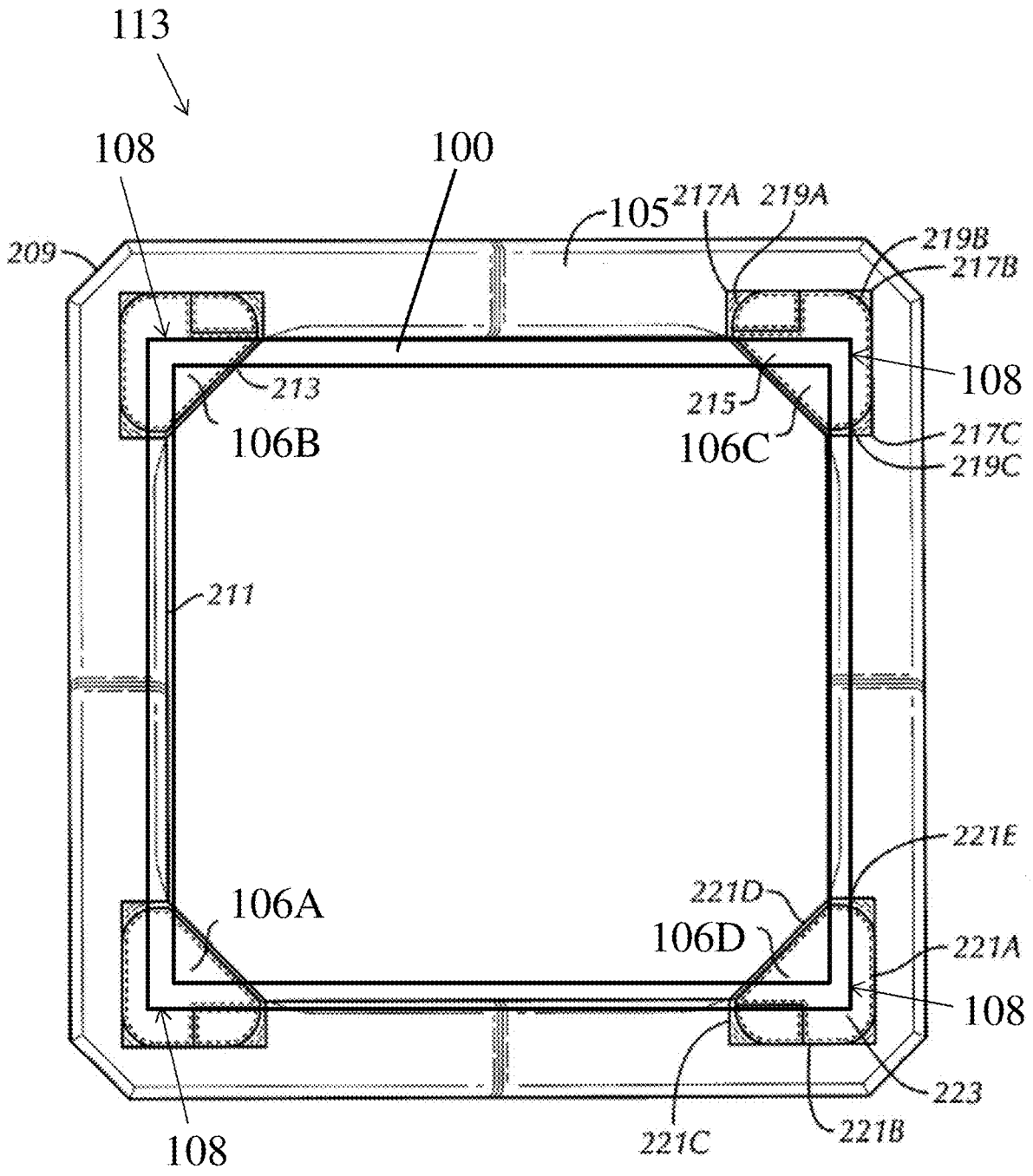
FIG. 2B illustrates a top view of the offshore vessel of FIG. 2A in accordance with one or more embodiments of the present disclosure.

Turning to FIG. 2B, a top view of the offshore vessel 113 is shown. As shown in FIG. 2B, the pontoon base 105 may be generally rectangular, triangular, and/or polygonal in shape. In addition, one or more corners 209 of the pontoon base 105 may be chamfered (as shown). Alternatively, the pontoon base 105 may have one or more squared corners, one or more rounded corners, or any combination or alternative thereof (not shown). Further, and similarly, the interior 211 of the pontoon base 105 may have one or more chamfered corners 213 which may or may not correspond to the interior chamfered corners 209. Alternatively, the interior 211 of the pontoon base 105 may have one or more squared corners, one or more rounded corners, or any combination or alternative thereof (not shown).

In one or more embodiments, the cross-section 215 of the support columns 106A-106D may have five sides. One or more corners 217A, 217B, and 217C of the support columns 106A-106D may be squared, as shown. In addition, one or more edges 219A, 219B, and 219C of the support columns 106A-106D may be rounded, as shown. In this particular example, the one or more edges 219A, 219B, and 219C of t the support columns 106A-106D are rounded at one vertical end of the support column and squared at an opposite end of the support columns 106A-106D. Moreover, one or more sides 221A, 221B, 221C, 221D, and 221E, which correspond to cross-section 223, each represent a side of a support column. Alternatively, the corners or edges may be chamfered, rounded, squared, or any combination or alternative thereof.

Still referring to FIG. 2B, the topside truss system 100 is illustrated as an outline. This is for example purposes only to better show how the topside truss system 100 is supported by the support columns 106A-106D on the pontoon base 105. As shown by FIG. 2B, the corner beam members 108 of the topside truss system 100 are supported on the support columns 106A-106D.

Figure 2C:
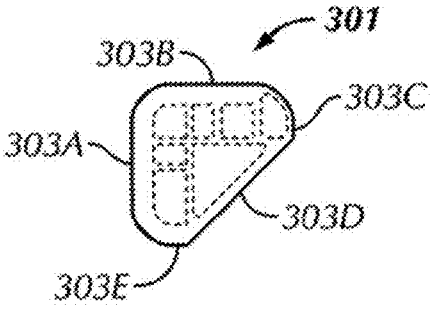
FIGS. 2C-2H illustrate various top views of a support column in accordance with one or more embodiments of the present disclosure.

With reference to FIGS. 2C-2H, a top view of one of the support columns is illustrated. In FIG. 2C, one or more sides 303A, 303B, 303C, 303D of the support column 301 may be disposed with respect to one another, as shown. Specifically, the first side 303A may be disposed at a first angle with respect to a second side 303B. The second side may be disposed at a second angle with respect to a third side 303C. The third side 303C may be disposed at a third angle with respect to a fourth side 303D. In this example, the first and second angle may be substantially right angles. Further, the third angle may be a substantially obtuse angle. An example obtuse angle may be substantially 135 degrees, as shown. However, an obtuse angle may be anywhere between any angle greater than 90 degrees and less than 180 degrees. Additionally, an obtuse angle may be anywhere between 91 and 179 degrees, 100 and 170 degrees, 110 and 160 degrees, 120 and 150 degrees, or 130 and 140 degrees. The fourth side 303D may be disposed at a fourth angle with respect to a fifth side 303E. The fifth side 303E may be disposed at a fifth angle with respect to the first side 303A. In this example, the fourth angle may be a substantially obtuse angle and the fifth angle may be a substantially right angle. In this example, the one or more sides 303A, 303B, 303C, 303D of the support column 301 may be joined with rounded corners. Alternatively, the one or more sides 303A, 303B, 303C, 303D of the support column 301 may be joined with chamfered corners, squared corners, or any alternate thereof. However, one of ordinary skill in the art would know and appreciate that the corners and corresponding sides of the support column are not limited to the above arrangement.

Figure 2D:
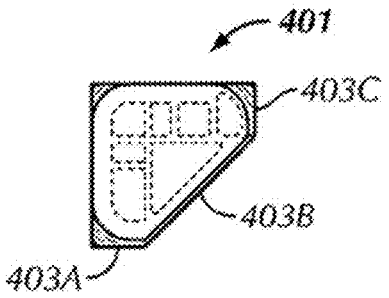

In FIG. 2D, one or more sides 403A, 403B, and 403C may extend outwardly along at least a portion of a support column 401. The outward extension, or "flaring," as shown, may be provided for additional support at the base of the support column 401. In addition, one of ordinary skill in the art would appreciate that the extension may be inward (not shown).

Figure 2E:
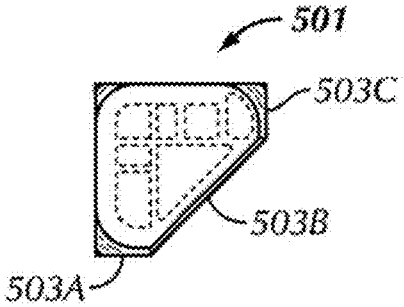

In FIG. 2E, one or more sides 503A, 503B, and 503C may extend outwardly (or inwardly) beginning at one end to another end of a support column 501. In this example, taper positions similar to FIG. 2D do not exist along a portion of the length of the support column 501. In particular, the flaring spans the entire length of the support column 501. Accordingly, the taper position may be at either or both ends of the support column and the flaring may extend along the entirety of the support column 501. Further, in this example, side 503B may not flare. Therefore, flaring may occur on any number of sides or none.

Figure 2F:
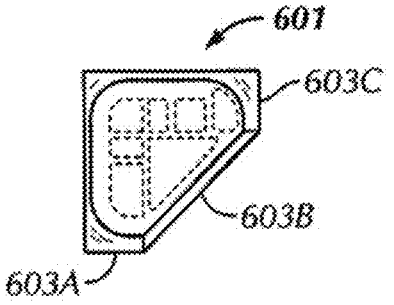

In FIG. 2F, one or more sides 603A, 603B, and 603C of a support column 601 may be a flared at the base. In this example, the side 603B also flares, One of ordinary skill in the art would know and appreciate that the taper positions may be at any position along the length of the support column 601.

Figure 2G:
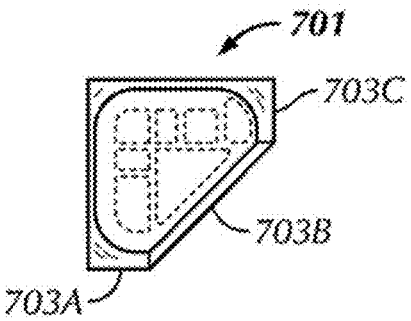

In FIG. 2G, one or more sides 703A, 703B, and 703C of a support column 701 may be flared at the base. In this example, taper positions similar to those described above in FIG. 2F do not exist along any portion of the length of support column 701. In particular, the flaring spans the entire length of the support column 701. Accordingly, the taper position may be at either or both ends of the support column and the flaring may extend along the entirety of the support column 701. Further, in this example, side 703B may or may not flare. Therefore, flaring may occur on any number of sides or none.

Figure 2H:
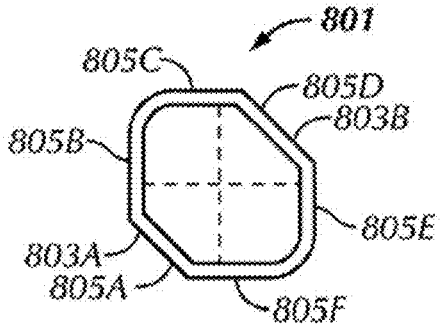

In FIG. 2H, a support column 801 has one or more chamfered sides 803A and 803B. The one or more chamfered sides 803A and 803B of the support column 801 may not be limited to an interior or an exterior with respect to a pontoon structure. In addition, and as shown in FIG. 2H, the cross-section of a support column 801 may include one or more edges 805A, 805B, 805C, 805D, 805E, and 805F that correspond to one or more sides of the support column 801. The edges 805A, 805B, 805C, 805D, 805E, and 805F may be arranged as shown in FIG. 2H. In particular, first edge 805A may be disposed at a first angle with respect to edge 805B. Edge 805B may be disposed at a second angle with respect to edge 805C. Edge 805C may be disposed at a third angle with respect to edge 805D. Edge 805D may be disposed at a fourth angle with respect to edge 805E. Edge 805E may be disposed at a fifth angle with respect to edge 805F. Edge 805F may be disposed at a sixth angle with respect to edge 805A. In addition, edges 805C and 805F may be chamfered and may correspond to chamfered sides 803A and 803B of the support column 801. In this example, the second and fifth angles may be substantially right angles and the first, third, fourth, and sixth angles may be substantially obtuse angles. An example obtuse angle may be substantially 135 degrees, as shown. However, an obtuse angle may be anywhere between any angle greater than 90 degrees and less than 180 degrees. Additionally, an obtuse angle may be anywhere between 91 and 179 degrees, 100 and 170 degrees, 110 and 160 degrees, 120 and 150 degrees, or 130 and 140 degrees. One skilled in the art would know and appreciate that the six sided column may or may not include any or all of the features disclosed herein with respect to any of the embodiments of the multi-sided column as described above. For example, in one or more embodiments, the six sided column may include one or more of the following: one or more transition regions, one or more taper positions, and flaring. In addition, in one or more embodiments, the six sided column may include one or more of the following: rounded edges or corners, squared edges or corners, and chamfered edges or corners. As understood by one having ordinary skill, the aforementioned features are provided as examples and the embodiments herein should not be limited to those above features.

Figure 3:
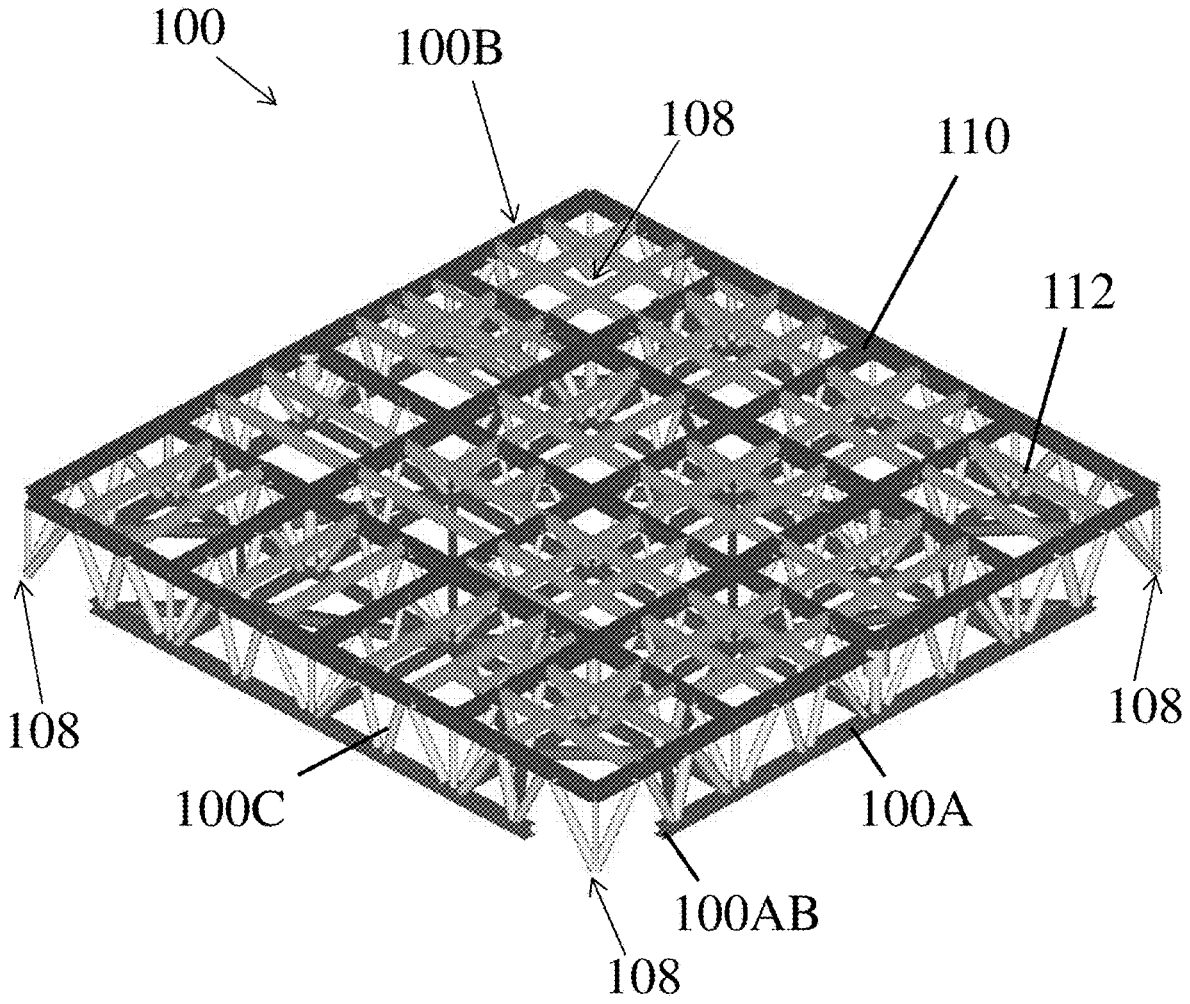
FIG. 3 illustrates a perspective view of the truss system of FIG. 2A in accordance with one or more embodiments of the present disclosure.

Now referring to FIG. 3, a perspective view of the topside truss system 100 is shown. The upper deck 100B of the topside truss system 100 directly supports equipment used for drilling, production, or other operations and therefore operating equipment, personnel, and operation gear may be disposed thereon. To support the equipment, the upper deck 100B may be formed by a plurality of beams (e.g., steel I-beams) in which the equipment fits within or upon. The periphery edge may be generally square, rectangular, and/or polygonal in shape. The upper deck 100B includes a first set of beams 110 and a second set of beams 112. The first set of beams 110 form the major truss rows. The second set of beams 112 may be orientated in a horizontal direction or in a transverse direction.

In one or more embodiments, the tubular members 100C space the upper deck 100B a distance from the lower deck 100A. The tubular members 100C may be angled to support the upper deck 100B on the lower deck 100A. Additionally, the corner beam members 108 connect the topside truss system 100 to the support columns (see 106A-106D in FIG. 2A-2H). In some embodiments, the lower deck 100A does not traverse into the corner beam members 108. Additionally, the lower deck 100A may include two corresponding corner beam ends 100AB for each corner beam members 108. Each corner beam ends 100AB are also affixed to the top of the four support columns (see 106A-106D in FIG. 2A-2H) a distance from each corner beam members 108.

In one or more embodiments, in the concept design phase of the lower deck 100A, the governing load cases may be simplified environmental loads combined with the inertial loads of the mass on the lower deck 100A and the upper deck 100B. The upper deck 100B and the lower deck 100A may be optimized to determine material distribution and voids of various shapes inside the deck to handle the governing load cases.

Figure 4:
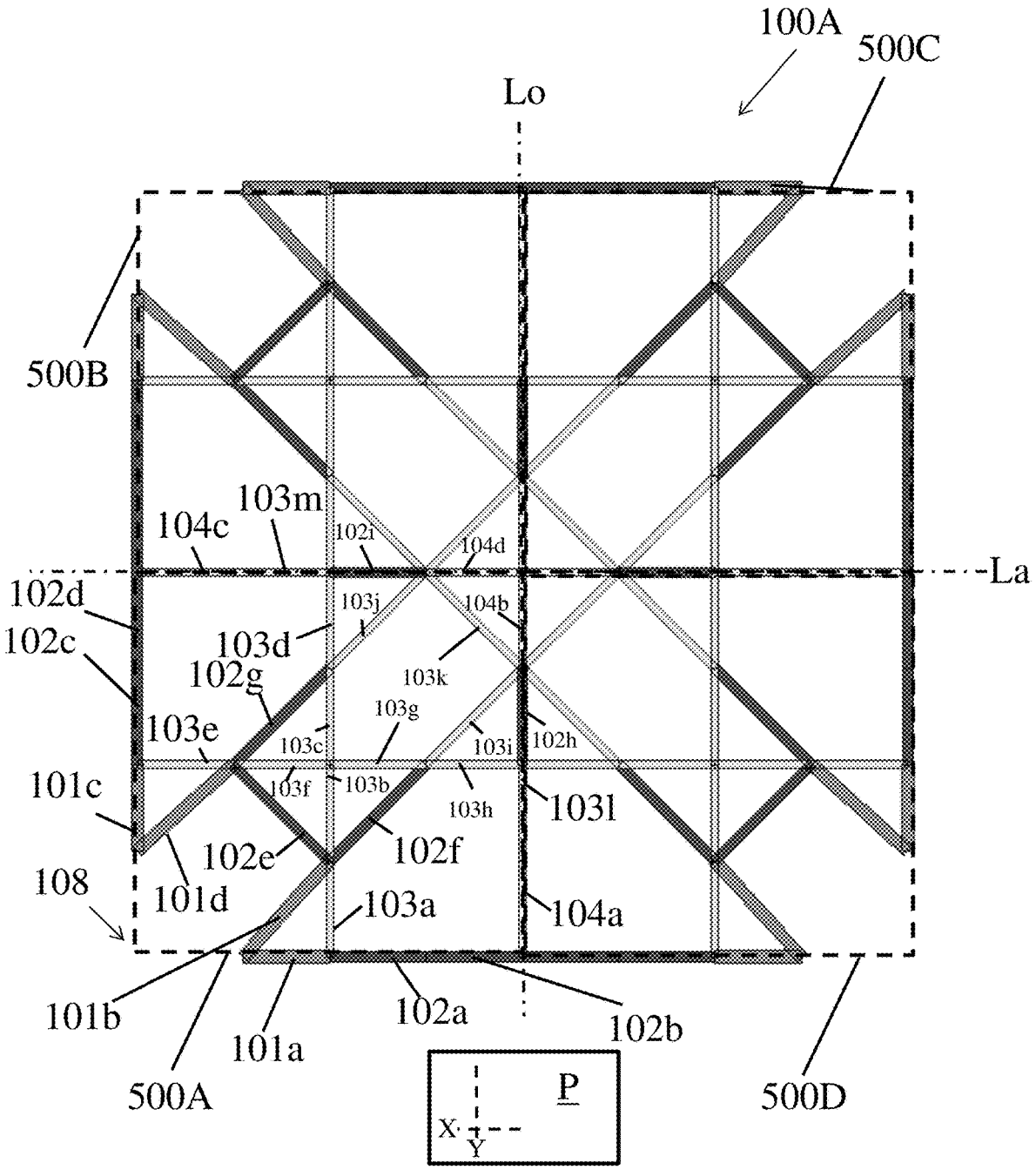
FIGS. 4 and 5 illustrate a top view of a truss system in accordance with one or more embodiments of the present disclosure.
Figure 5:
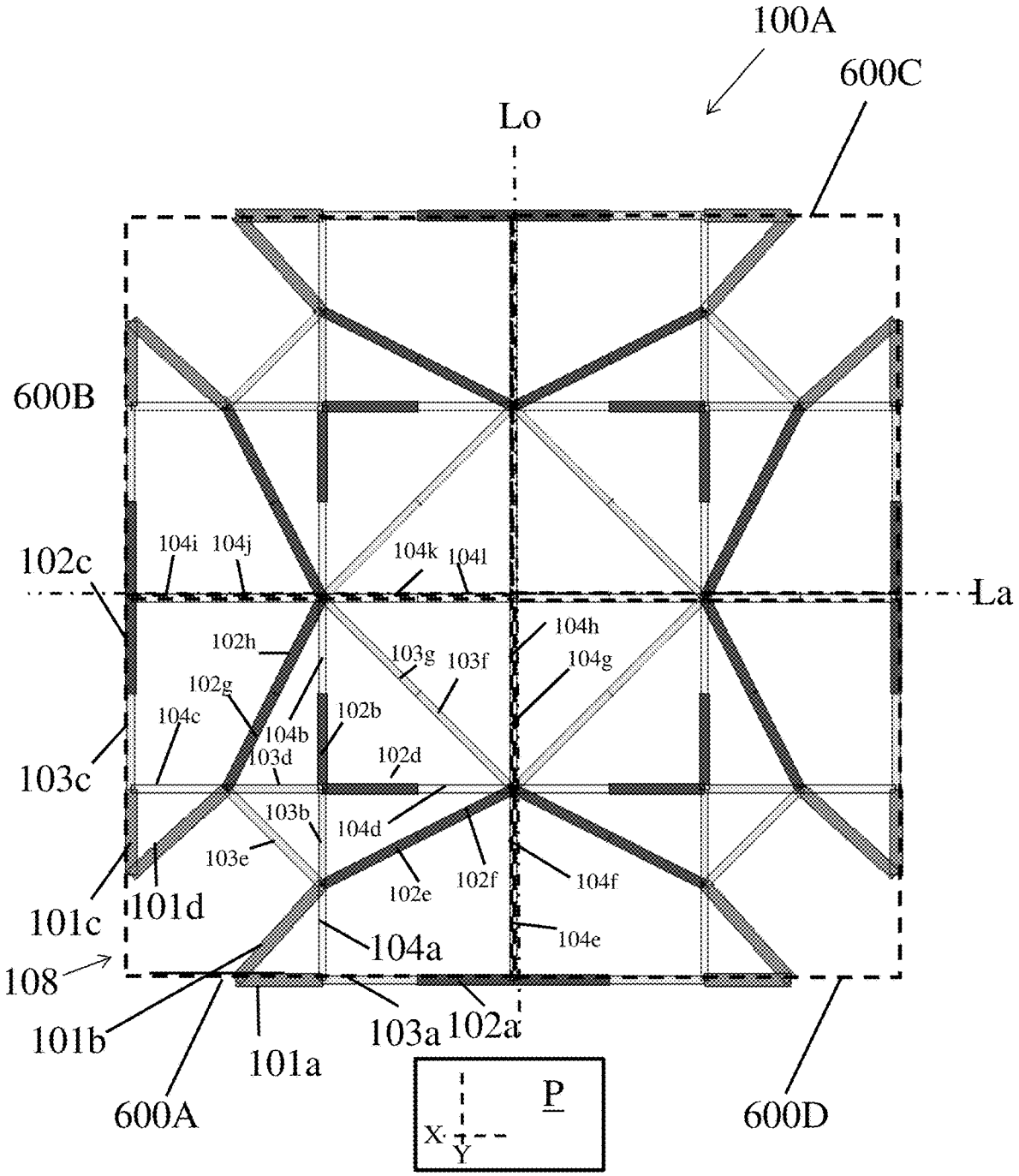

With reference to the configuration of FIGS. 4 and 5, the lower deck 100A may be formed by a plurality of beams (101*a*-104*l*) arranged in a plane P. The plane P may be a plane in which the lower deck 100A lays within. For example, the plane P may be substantially parallel to the pontoon base (see 105 in FIGS. 1-2B). The plurality of beams (101*a*-104*l*) may use a wide variety of beams in structural support operations. One skilled in the art will appreciate how the lower deck 100A may be able to achieve increased performance, decreased non-productive time (NPT), and improved equipment life and maintenance.

In one or more embodiments, the plurality of beams (101*a*-104*l*) of the lower deck 100A may include a first set of beams (101*a*-101*d*), a second set of beams (102*a*-102*i*), a third set of beams (103*a*-103*m*), and a fourth set of beams (104*a*-104*l*). Each set may have the same cross-section or varying cross-sections. It is understood that depending on the size, shape, and configuration of vessels (and its usage), different sizes, numbers and/or types of beam may be used. Additionally, the first set of beams (101*a*-101*d*), the second set of beams (102*a*-102*i*), the third set of beams (103*a*-103*m*), and the fourth set of beams (104*a*-104*l*) may be connected together at their ends, midpoints, or along any length of the beams (101*a*-104*l*). For example, the connection point between two beams may be end to end to and/or an end of one beam to a midpoint of another beam. Further, one beam may be connected to two beams at corresponding midpoints of two beam. It is further envisioned that one beam may be connected to two beams at a corresponding midpoint of one beam to an end of another beam. One skilled in the art will appreciate how the connection point may be adjusted to meet loading requirements on the plurality of beams (101*a*-104*l*).

In FIG. 4, the plurality of beams (101*a*-104*d*) may have a first geometry to optimally distribute structural material to have a balance between structural weight and structural strength. The first set of beams (101*a*-101*d*) may be arranged to have beams extending parallel to an X-axis X in the plane P, parallel to a Y-axis Y in the plane P, and angled at an acute or obtuse angle off the axis' X, Y. The second set of beams (102*a*-102*i*) may be arranged to have beams extending parallel to the X-axis X in the plane P, parallel to the Y-axis Y in the plane P, and angled at an acute or obtuse angle off the axis' X, Y. The third set of beams (103*a*-103*m*) may be arranged to have beams extending parallel to the X-axis X in the plane P, parallel to the Y-axis Y in the plane P, and angled at an acute or obtuse angle off the axis' X, Y. The fourth set of beams (104*a*-104*d*) may be arranged to have beams extending parallel to the X-axis X in the plane P and parallel to the Y-axis Y in the plane P.

In one or more embodiments, the configuration in FIG. 4 of the lower deck 100A may include one or more quadrants of similar design. For example, the lower deck 100A may have four quadrants as represented by dotted boxes 500A-500D. The lower deck 100A may also be symmetrical about a line of symmetry extending diagonally corner to corner. For example, each quadrant 500A-500D includes the same number of beams from the first set of beams (101*a*-101*d*), the second set of beams (102*a*-102*i*), the third set of beams (103*a*-103*m*), and the fourth set of beams (104*a*-104*d*) in the same geometry. Specifically, each quadrant 500A-500D has four beams from the first set of beams (101*a*-101*d*), nine beams from the second set of beams (102*a*-102*i*), thirteen beams from the third set of beams (103*a*-103*m*), and four beams from the fourth set of beams (104*a*-104*d*). It is further envisioned that the quadrants 500A-500D are symmetrical about longitudinal axis Lo and latitudinal axis LA. Alternatively, the lower deck 100A may be unsymmetrical at some local areas.

In each quadrant 500A-500D, from the corner beam members 108, the four beams of the first set of beams (101*a*-101*d*) have the geometry of a first beam 101*a* extending in the X-axis X with a second beam 101*b* acutely angled off the first beam 101*a*, and a third beam 101*c* extending in the Y-axis Y with a fourth beam 101*d* acutely angled off the third beam 101*c*. From the first beam 101*a* of the first set of beams extending in the X-axis X, two beams 102*a*-102*b* of the second set of beams (102*a*-102*i*) extend further in the X-axis X and four beams 103*a*-103*d* of the third set of beams (103*a*-103*m*) extend further in the Y-axis Y. From the third beam 101*c* of the first set of beams (101*a*-101*d*) extending in the Y-axis Y, two beams 102*c*-102*d* of the second set of beams (102*a*-102*i*) extend further in the Y-axis Y and four beams 103*e*-103*h* of the third set of beams (103*a*-103*m*) extend further in the X-axis X. From a distal end from the second beam 101*b* acutely angled off the first beam 101*a*, a beam 102*e* of the second set of beams (102*a*-102*i*) extends perpendicularly to a distal end from the fourth beam 101*d* acutely angled off the third beam 101*c*. Further, from each distal end of the second beam 101*b* and the fourth beam 101*d*, a beam 102*f*-102*g* from the second set of beams (102*a*-102*i*) extends further in the angled direction with a beam 103*i*-103*j* from the third set of beams (103*a*-103*m*) at the distal end of the beam 102*f*-102*g*. Additionally, a beam 103*k* from the third set of beams (103*a*-103*m*) extends in direction perpendicularly from the beam 103*i* to the beam 103*j* at a distal end of beam 102*e*.

In some embodiments, each quadrant 500A-500D share a first set of a beam 104*a* from the fourth set of beams (104*a*-104*d*), a beam 103*l* from the third set of beams (103*a*-103*m*), a beam 102*h* from the second set of beams (102*a*-102*i*), and a beam 104*b* from the fourth set of beams 104 extending in a line in the Y-axis Y and a second set of a beam 104*c* from the fourth set of beams (104*a*-104*d*), a beam 103*m* from the third set of beams (103*a*-103*m*), a beam 102*i* from the second set of beams (102*a*-102*i*), and a beam 104*d* from the fourth set of beams (104*a*-104*d*) extending in a line in the X-axis X.

In FIG. 5, the plurality of beams (101*a*-104*l*) may have a second geometry to optimally distribute structural material to have a balance between structural weight and structural strength. The first set of beams (101*a*-101*d*) may be arranged to have beams extending parallel to an X-axis X in the plane P, parallel to a Y-axis Y in the plane P, and angled at an acute or obtuse angle off the axis' X, Y. The second set of beams (102*a*-102*h*) may be arranged to have beams extending parallel to the X-axis X in the plane P, parallel to the Y-axis Y in the plane P, and angled at an acute or obtuse angle off the axis' X, Y. The third set of beams (103*a*-103*g*) may be arranged to have beams extending parallel to the X-axis X in the plane P, parallel to the Y-axis Y in the plane P, and angled at an acute or obtuse angle off the axis' X, Y. The fourth set of beams (104*a*-104*l*) may be arranged to have beams extending parallel to the X-axis X in the plane P and parallel to the Y-axis Y in the plane P.

In one or more embodiments, the configuration in FIG. 5 of the lower deck 100A may include four symmetrical quadrants, as represented by dotted boxes 600A-600D. For example, each quadrant 600A-600D includes the same number of beams from the first set of beams (101*a*-101*d*), the second set of beams (102*a*-102*h*), the third set of beams (103*a*-103*g*), and the fourth set of beams (104*a*-104*l*) in the same geometry. Specifically, each quadrant 600A-600D has four beams from the first set of beams (101*a*-101*d*), eight beams from the second set of beams (102*a*-102*h*), seven beams from the third set of beams (103*a*-103*g*), and twelve beams from the fourth set of beams (104*a*-104*l*). It is further envisioned that the quadrants 600A-600D are symmetrical about longitudinal axis Lo and latitudinal axis LA. Alternatively, the lower deck 100A may be unsymmetrical at some local areas.

In each quadrant 600A-600D, from the corner beam members 108, the four beams of the first set of beams (101*a*-101*d*) have the geometry of a first beam 101*a* extending in the X-axis X with a second beam 101*b* acutely angled off the first beam 101*a*, and a third beam 101*c* extending in the Y-axis Y with a fourth beam 101*d* acutely angled off the third beam 101*c*. From the first beam 101*a* of the first set of beams (101*a*-101*d*) extending in the X-axis X, a beam 103*a* of the third set of beams (103*a*-103*g*) and a beam 102*a* of the second set of beams (102*a*-102*h*) extend further in the X-axis X and a beam 104*a* of the fourth set of beams (104*a*-104*l*), a beam 103*b* of the third set of beams (103*a*-103*g*), a beam 102*b* of the second set of beams (102*a*-102*h*), and a beam 104*b* of the fourth set of beams (104*a*-104*l*) extend further in the Y-axis Y. From the third beam 101*c* of the first set of beams (101*a*-101*d*) extending in the Y-axis Y, a beam 103*c* of the third set of beams (103*a*-103*g*) and a beam 102*c* of the second set of beams (102*a*-102*h*) extend further in the X-axis X and a beam 104*c* of the fourth set of beams (104*a*-104*l*), a beam 103*d* of the third set of beams (103*a*-103*g*), a beam 102*d* of the second set of beams (102*a*-102*h*), and a beam 104*d* of the fourth set of beams (104*a*-104*l*) extend further in the Y-axis Y. From a distal end from the second beam 101*b* acutely angled off the first beam 101*a*, a beam 103*e* of the third set of beams (103*a*-103*g*) extends perpendicularly to a distal end from the fourth beam 101*d* acutely angled off the third beam 101*c*. Further, from each distal end of the second beam 101*b* and the fourth beam 101*d*, beams 102*e*-102*h* from the second set of beams (102*a*-102*h*) extends in a direction angled off the second beam 101*b* and the fourth beam 101*d*. Additionally, beams 103*f*-103*g* from the third set of beams (103*a*-103*g*) extend from the beam 102*f* to the beam 102*h* to be parallel to the beam 103*e*.

In some embodiments, each quadrant 600A-600D share a first set of four beams 104*e*-104*h* from the fourth set of beams (104*a*-104*l*) extending in a line in the Y-axis Y and a second set of four beams 104*i*-104*l* from the fourth set of beams (104*a*-104*l*) extending in a line in the X-axis X.

Based on the geometry in FIGS. 5 and 6, in one or more embodiments, various equipment used in the lower deck 100A may be connected at any point along the first set of beams (101*a*-101*d*), the second set of beams (102*a*-102*h*), the third set of beams (103*a*-103*g*), and the fourth set of beams (104*a*-104*l*). The various equipment may be any equipment to conduct oil and gas operations.

In addition to the benefits described above, the optimized lower deck configuration may improve an overall efficiency and performance at the offshore vessel while reducing cost, minimize product engineering, reduction of assembly time, hardware cost reduction, weight and envelope reduction, and many other advantages. Further, the optimized lower deck configuration may provide further advantages such as reducing the structural weight of the lower deck while maintaining or improving operation utilization, improving equipment life and maintenance, and improving site safety. It is noted that the optimized lower deck configuration may be used for any onshore and offshore oil and gas operations.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A lower deck for a topside truss system of an offshore vessel, the lower deck comprising:

a plurality of beams distributed into four quadrants, wherein the plurality of beams extend in a direction parallel to an X-axis in a plane of the lower deck, parallel to a Y-axis in the plane, and angled at an acute or obtuse angle off the X-axis and the Y-axis, each quadrant comprising:

a first set of beams having at least four beams of a constant or varying cross-section;

a second set of beams having at least eight beams of a constant or varying cross-section;

a third set of beams having at least seven beams of a constant or varying cross-section; and a fourth set of beams having at least four beams of a constant or varying cross-section.

2. The lower deck of claim 1, wherein the four quadrants are symmetrical about a longitudinal axis of the lower deck and a latitudinal axis of the lower deck.

3. The lower deck of claim 1, wherein from a corner of a corresponding quadrant a first beam of the first set of beams extends in the X-axis with a second beam of the first set of beams extends acutely angled off the first beam, and a third beam of the first set of beams extends in the Y-axis with a fourth beam of the first set of beams extends acutely angled off the third beam, from the first beam of the first set of beams extending in the X-axis, two beams of the second set of beams extend further in the X-axis and four beams of the third set of beams extend further in the Y-axis, from the third beam of the first set of beams extend in the Y-axis, two beams of the second set of beams extend further in the Y-axis and four beams of the third set of beams extend further in the X-axis, from a distal end from the second beam acutely angled off the first beam, a beam of the second set of beams extends perpendicularly to a distal end from the fourth beam acutely angled off the third beam, from each distal end of the second beam and the fourth beam, a beam from the second set of beams extends further in the angled direction with a beam from the third set of beams at the distal end, and a beam from the third set of beams extends in direction perpendicularly from the beam from the third set of beams at the distal end of the beam from the second set of beams extending further in the angled direction.

4. The lower deck of claim 3, wherein each quadrant shares a first set of a beam from the fourth set of beams, a beam from the third set of beams, a beam from the second set of beams, and a beam from the fourth set of beams extending in a line in the Y-axis, and a second set of a beam from the fourth set of beams, a beam from the third set of beams, a beam from the second set of beams, and a beam from the fourth set of beams extending in a line in the X-axis.

5. The lower deck of claim 1, wherein from a corner of a corresponding quadrant a first beam of the first set of beams extends in the X-axis with a second beam of the first set of beams extends acutely angled off the first beam, and a third beam of the first set of beams extends in the Y-axis with a fourth beam of the first set of beams extends acutely angled off the third beam, from the first beam of the first set of beams extending in the X-axis, a beam of the third set of beams and a beam of the second set of beams extend further in the X-axis, and a beam of the fourth set of beams, a beam of the third set of beams, a beam of the second set of beams, and a beam of the fourth set of beams extend further in the Y-axis, from the third beam of the first set of beams extending in the Y-axis, a beam of the third set of beams and a beam of the second set of beams extend further in the X-axis, and a beam of the fourth set of beams, a beam of the third set of beams, a beam of the second set of beams, and a beam of the fourth set of beams extend further in the Y-axis, from a distal end from the second beam acutely angled off the first beam, a beam of the third set of beams extends perpendicularly to a distal end from the fourth beam acutely angled off the third beam, from each distal end of the second beam and the fourth beam, four beams from the second set of beams extends in a direction angled off the second beam and the fourth beam, two beams from the third set of beams extend from the beams from the second set of beams that extends in the direction angled off the second beam and the fourth beam.

6. The lower deck of claim 5, wherein each quadrant shares a first set of four beams from the fourth set of beams extending in a line in the Y-axis and a second set of four beams from the fourth set of beams extending in a line in the X-axis.

7. An offshore vessel comprising:

a base having one or more support columns disposed thereon; and a deck formed by a topside truss system supported by the one or more support columns, the topside truss system comprising:

an upper deck;

a lower deck; and tubular members interconnecting the upper deck to the lower deck, the lower deck having one or more quadrants comprising:

a first set of beams having at least four beams of a constant or varying cross-section;

a second set of beams having at least eight beams of a constant or varying cross-section;

a third set of beams having at least seven beams of a constant or varying cross-section; and a fourth set of beams having at least four beams of a constant or varying cross-section;

wherein corresponding corner beam members of the topside truss system are affixed to a top of the one or more support columns.

8. The offshore vessel of claim 7, wherein the offshore vessel is a semisubmersible.

9. The offshore vessel of claim 8, wherein the base is a pontoon base.

10. The offshore vessel of claim 9, wherein the one or more support columns support further comprises:

a column having six sides;

a first side of the column and a second side of the column disposed at a first angle with respect to each other;

the second side of the column and a third side of the column disposed at a second angle with respect to each other;

the third side of the column and a fourth side of the column disposed at a third angle with respect to each other;

the fourth side of the column and a fifth side of the column disposed at a fourth angle with respect to each other;

the fifth side of the column and a sixth side of the column disposed at a fifth angle with respect to each other; and the sixth side of the column and the first side of the column disposed at a sixth angle with respect to each other, wherein the pontoon base is disposed at a lower end of the column.

11. The offshore vessel of claim 9, wherein the one or more support columns support further comprises:

a column having five sides;

a first side of the column and a second side of the column disposed at a first angle with respect to each other;

the second side of the column and a third side of the column disposed at a second angle with respect to each other;

the third side of the column and a fourth side of the column disposed at a third angle with respect to each other;

the fourth side of the column and a fifth side of the column disposed at a fourth angle with respect to each other; and the fifth side of the column and the first side of the column disposed at a fifth angle with respect to each other, wherein the pontoon base is disposed at a lower end of the column, and wherein at least one side of the column comprises a taper position such that the at least one side flares outwardly or inwardly along at least a portion of the length of the column.

12. The offshore vessel of claim 7, wherein the upper deck comprises a periphery edge with a fifth set of beams and a sixth set of beams, wherein the fifth set of beams form major truss rows and the sixth set of beams are orientated in a horizontal direction or in a transverse direction.

13. The offshore vessel of claim 7, wherein the tubular members are angled to space the upper deck a distance above the lower deck.

14. The offshore vessel of claim 7, wherein the lower deck does not traverse into the corresponding corner beam members of the topside truss system.

15. The offshore vessel of claim 14, wherein corresponding corner beam ends of the lower deck are affixed to the top of the four support columns a distance from the corresponding corner beam members.

16. The offshore vessel of claim 7, wherein the lower deck is symmetrical about a diagonal axis.

17. An offshore vessel comprising:

a base having support columns disposed thereon; and a deck formed by a topside truss system supported by the support columns, the topside truss system comprising:

an upper deck;

a lower deck, the lower deck having one or more quadrants comprising:

a first set of beams having a constant or varying cross-section;

a second set of beams having a constant or varying cross-section;

a third set of beams having a constant or varying cross-section; and a fourth set of beams having a constant or varying cross-section;

tubular members interconnecting the upper deck to the lower deck; and corner beam members at corners of the topside truss system, wherein the corner beam members connect the upper deck to a top of one or more of the support columns; and wherein the corner beam members do not traverse into the lower deck.

18. The offshore vessel of claim 17, wherein the lower deck comprises corner beam ends at the corners of the topside truss system, wherein the corner beam ends are affixed to the top of one or more of the support columns, and wherein the corner beam ends are spaced a distance from the corner beam members at corresponding corners of the topside truss system.

* * * * *